United States Patent [19]

Shirley

[11] Patent Number: 4,682,155

[45] Date of Patent: Jul. 21, 1987

[54] PERSONNEL SECURITY SYSTEM

[75] Inventor: John R. Shirley, Crestwood, Mo.

[73] Assignee: Central Security Mfg. Corp., Fenton, Mo.

[21] Appl. No.: 818,260

[22] Filed: Jan. 13, 1986

[51] Int. Cl.[4] ..... G08B 13/08; G08B 13/18

[52] U.S. Cl. ..... 340/573; 340/522; 340/545; 340/572

[58] Field of Search ..... 340/573, 572, 545, 522

[56] References Cited

U.S. PATENT DOCUMENTS

| | | | |
|---|---|---|---|
| 3,163,856 | 12/1964 | Kirby | 340/573 |
| 3,665,448 | 5/1972 | McGlinchey et al. | 340/545 |
| 3,972,320 | 8/1976 | Kalman | 340/573 |
| 4,063,410 | 12/1977 | Welling | 340/573 |
| 4,095,214 | 6/1978 | Minasy | 340/572 |
| 4,314,240 | 2/1982 | Schnüg | 340/573 |
| 4,476,461 | 10/1984 | Carubia | 340/545 |
| 4,555,696 | 11/1985 | Brown | 340/572 |
| 4,598,275 | 7/1986 | Ross et al. | 340/573 |

*Primary Examiner*—Glen R. Swann, III

*Attorney, Agent, or Firm*—Haverstock, Garrett & Roberts

[57] ABSTRACT

A security sensing system monitors the passage of persons through a door or like opening. A transmitter module having means for transmitting an omnidirectional signal is installed on persons to be monitored and a sensing module for installing adjacent to a door opening to be monitored. The sensing module operates an alarm, but only when the door is opened by a person equipped with a trigger module on his person.

18 Claims, 7 Drawing Figures

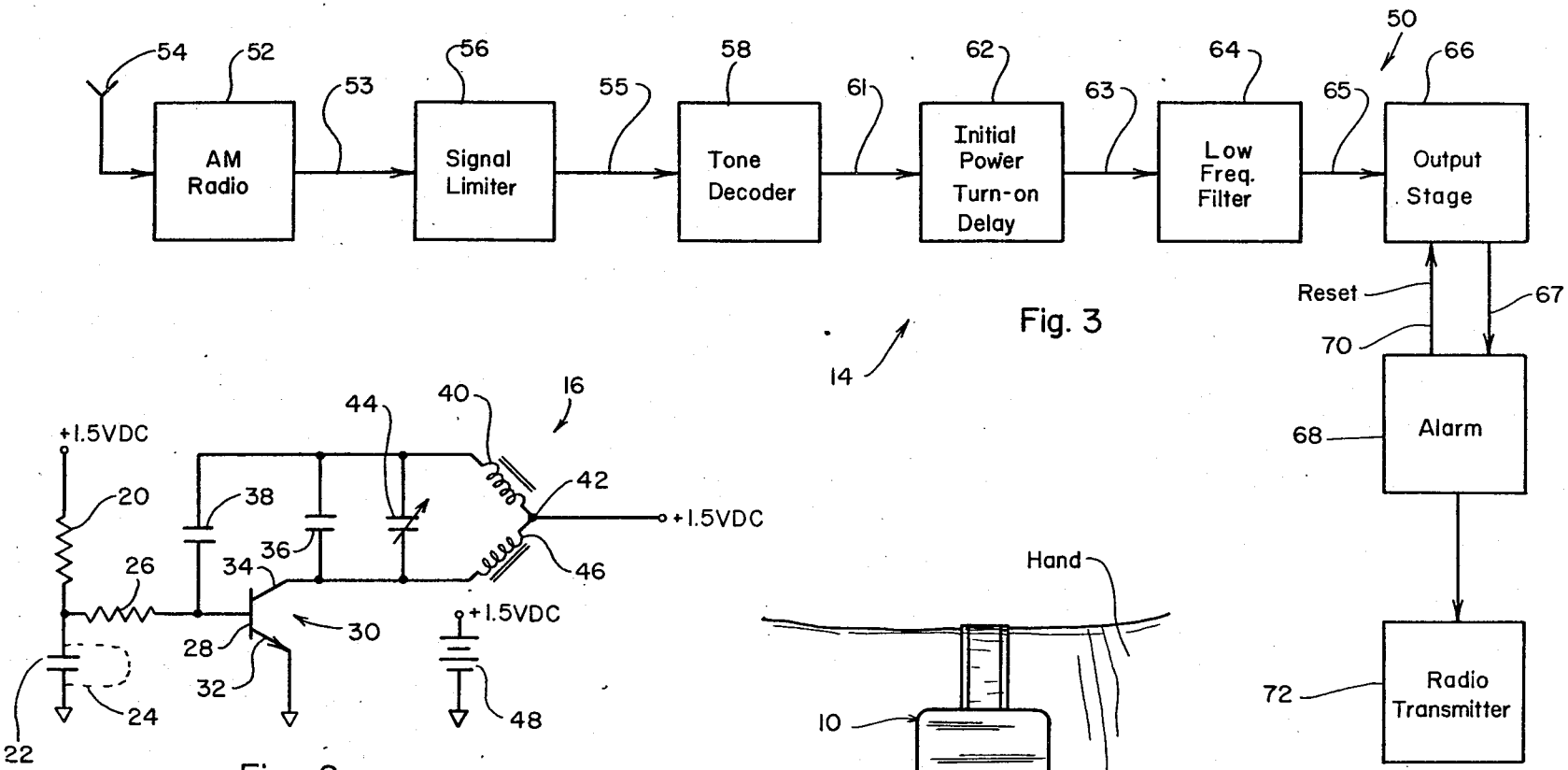
Fig. 3
Fig. 2
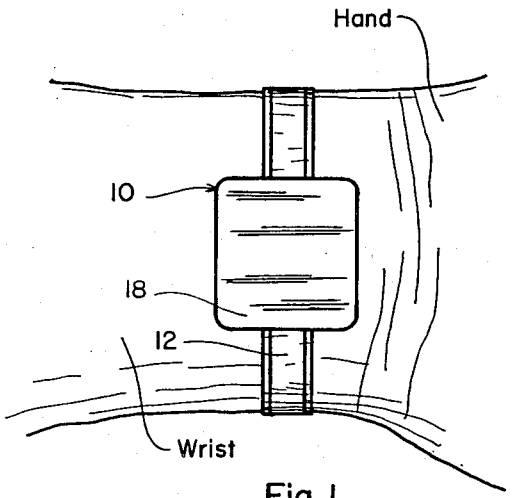
Fig. 1

PERSONNEL SECURITY SYSTEM

The present invention relates generally to personnel security systems and more specifically to a personnel security system for use in nursing homes for the aged, institutions for the feeble-minded and mentally deficient, and similar places where there is a need to alert the staff to any unauthorized departure of a resident through a door such as through an outside door. The present system includes portable units or trigger modules worn on the wrists of the residents being monitored, which units are constructed to transmit omnidirectional signals over a limited range such as a few feet, and a receiver unit or module for mounting on or adjacent to a door to be monitored, which receiver unit is constructed to receive signals transmitted by the trigger modules whenever a resident equipped with a trigger module tries to exit the premises by opening the door and passing therethrough.

PRIOR ART

There are many known systems that are used to signal the occurrence of some condition for some reason. For example, there are systems that are used to prevent shoplifting by attaching a transmitter device to certain articles of merchandise in a store, see for example the system disclosed in McGlinchey et al U.S. Pat. No. 3,665,448; there are transmitter/receiver systems used as patient monitoring systems that transmit information from means attached to or worn by a patient as to one or more conditions of the patient's body such as body temperature or pulse rate and such systems may include means for transmitting information to identify a particular patient whose transmission is being sent, see for example the system disclosed in Kalman U.S. Pat. No. 3,972,320. There are also occupancy monitoring type systems used by stores, hotels and other public places to keep a record of the occupancy use being made of certain facilities and so forth, see for example the system disclosed in Carubia U.S. Pat. No. 4,476,461. There are systems used on wristwatches to transmit information for activating a remote electronic circuit for some purpose such as to alert the police of a robbery or other emergency situation, see Welling U.S.Pat. No. 4,063,410. Another, more complicated, prior art system used for locating persons is disclosed in Schnüg Pat. No. 4,314,240. All known prior art systems are designed for very specific purposes and to provide certain specific kinds of information, but no known system is designed specifically for monitoring the movements of certain persons such as certain residents of a nursing home through specific doors and includes simple transmitter modules to be worn on the wrists of the residents being monitored, which modules continuously transmit omnidirectional signals that are received by a receiver unit located on or adjacent to the door or doorway, but only when the door is opened by a person so equipped. This is done to alert the staff of the institution that one of its residents is making an unauthorized exit. Because of the high cost of nursing home care and the kind of trouble enfeebled persons can get into if they are left to their own devices, it is important to provide relatively inexpensive, disposable, yet highly reliable, means to monitor certain actions of such residents in order to keep track of them and to keep them in a safe controlled environment. The present system meets these requirements.

The present system includes a wrist worn trigger module which is adapted to be attached to a wristband, such as to a plastic hospital type wristband, which can be locked onto the wrist and cannot be easily removed by the resident without a special tool. The system also includes a receiver module for mounting on or adjacent to a door or doorway to be monitored. The transmitter and receiver modules preferably have good omnidirectional transmitting and receiving characteristics, and the receiving module can be installed for use on single door doorways and on double door doorways with some modification.

It is a principal object of the present invention to provide a relatively inexpensive, easy to install reliable means for knowing when a resident of a nursing home, hospital, asylum or other type institution opens and is departing through an unauthorized doorway.

Another object is to provide means for alerting the staff of a nursing home or like institution when a resident thereof equipped with the subject system opens an exit door equipped with suitable receiver means.

Another object is to reduce the cost of keeping track of residents of nursing homes and the like.

Another object is to provide transmitter means having omnidirectional transmission characteristics designed to be worn on the wrist of a person.

Another object is to provide a relatively inexpensive, compact, lightweight, sealed, battery operated transmitter device capable of operating over an extended period of time before needing to be replaced.

Another object is to provide a disposable transmitter device to be worn by residents of institutions such as nursing homes and the like to alert the staff when a resident is attempting to exit the premises.

Another object is to provide a waterproof battery operated transmitter device capable of transmitting a relatively low power omnidirectional radio frequency signal over a relatively short distance for an extended period of time.

Another object is to provide a relatively low power transmitter device capable of operating for an extended period of time on a relatively small battery source.

Another object is to provide a disposable sealed transmitter device which can be stored in a deactivated condition until ready for use in order to conserve battery life.

Another object is to provide a disposable battery operated transmitter which can be relatively easily activated to place it in operating condition.

Another object is to teach the construction of a relatively small transmitter device which can be relatively simply and easily checked for operating accuracy.

Another object is to teach the construction and operation of a relatively simple yet rugged transmitter having a minimum number of parts.

Another object is to teach the construction and operation of a relatively inexpensive receiver for mounting on or adjacent to a door, which receiver may have an antenna portion for mounting on the door itself.

Another object is to provide a receiver module which can be effectively installed for use with single and double door openings.

BRIEF DESCRIPTION OF THE DRAWINGS

These and other objects and advantages of the present invention will become apparent after considering the following detailed specification in conjunction with the accompanying drawings wherein:

FIG. 1 is a front view of a trigger module and a mounting strap therefor shown mounted on the wrist of a person;

FIG. 2 is a schematic circuit diagram of the circuit of the trigger module shown in FIG. 1;

FIG. 3 is a block diagram of the circuit of a receiver module used for receiving signals transmitted by the trigger module of FIGS. 1 and 2;

DETAILED DESCRIPTION OF THE INVENTION

Figure 4:
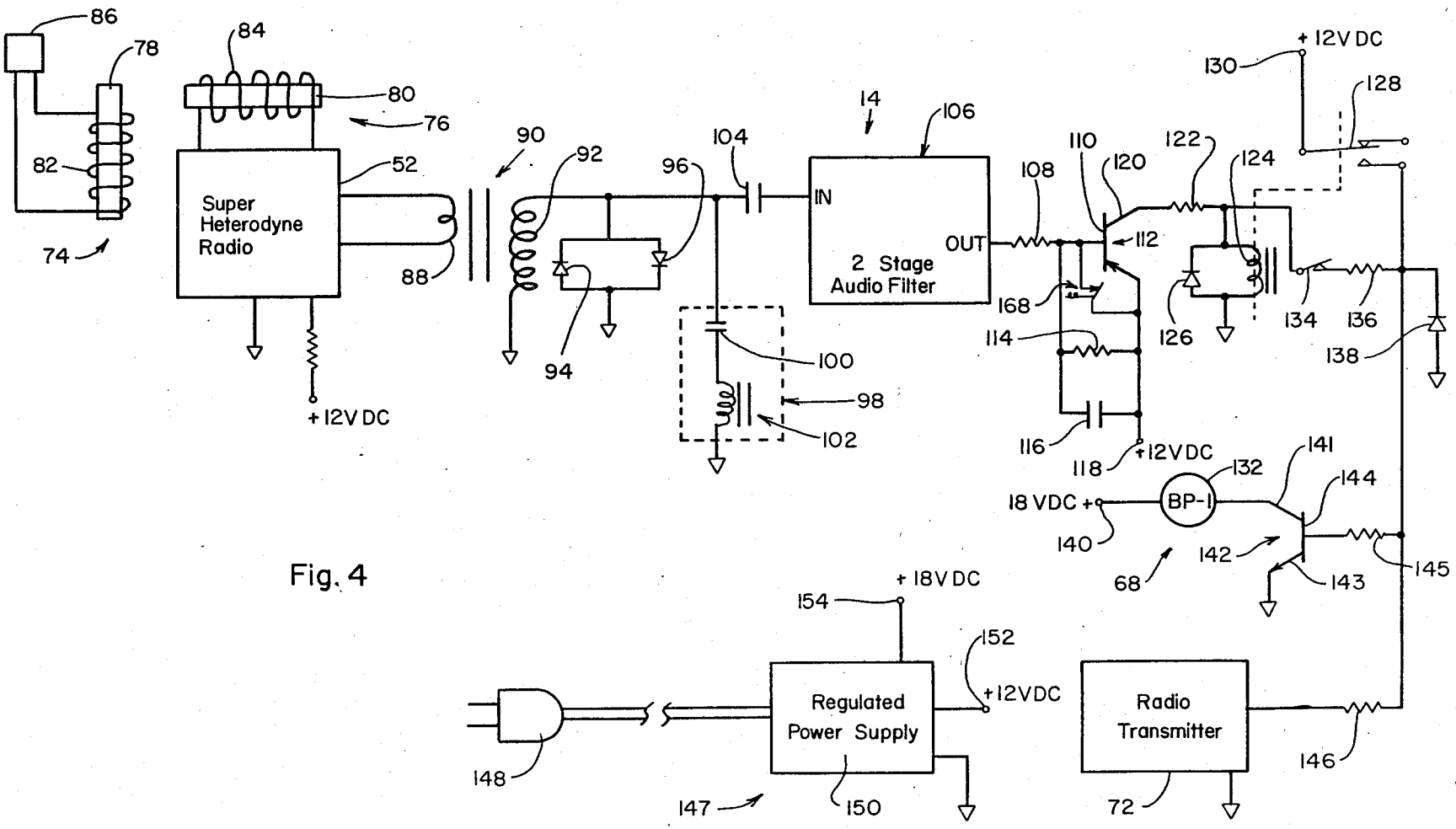
FIG. 4 is a schematic circuit diagram of the same receiver module shown in FIG. 3.

Referring to the drawings more particularly by reference numbers, number 10 identifies a transmitter module or unit constructed to be attached to a wristband 12 such as a plastic hospital wristband to be fixedly attached to the wrist of a resident of a nursing home or like institution. The typical wristband 12 is constructed to be secured about the wrist of the resident in such a manner that it cannot be easily removed by the resident, and it is intended that the wristband remain on the resident at all times and can only be removed by a staff person using a special tool for this purpose. The idea is to attach to the wristband 12 the transmitter module 10 and to attach such to the wrist of each person who should not leave the nursing home without being promptly detected so that they can be overtaken before they leave the premises. In today's world the typical nursing home may have any number of residents that need special monitoring, any number of exit doors, and a limited staff to keep track of the residents. Ordinarily it is not necessary to have a transmitter on the wrist of every person in the nursing home since many people will be happily situated and will not be inclined to try to leave without permission. However, there may be a number of residents who, for some reason or other, may try to wander off intentionally or unintentionally, and it is this group of residents for whom the present invention is primarily directed. The idea is that if such a resident opens a so-called unauthorized door, a door through which the residents should not pass without permission, the transmitter on his or her wrist which will be continuously transmitting, will have its signal picked up by receiver or sensing module 14 located on or adjacent to the door as soon as the door is opened. The signals so received will be used to energize some kind of alarm means at a remote station such as at a nursing station to alert the person or persons on duty that one of the residents is passing through the unauthorized doorway. This will enable the staff to retrieve the resident before the resident has gone very far.

The transmitter module 10 is preferably a relatively inexpensive, disposable battery operated module which continuously during the life of its battery transmits a low power signal over a relatively short distance such as over a few feet or so. Because of the way the transmitter is constructed, and especially the antenna portion thereof, the signals are transmitted omnidirectionally, as will be explained. This is done so that regardless of the orientation of the transmitter module 10 as it passes through the doorway, its signal will be picked up by antenna means associated with the receiver means 14, and the resident will not be able to defeat the system by orientating the transmitter module 10 in any particular orientation.

It is important to the present construction that the transmitter module 10 be relatively inexpensive, that it be battery operated, be a sealed unit so that it will not be damaged or made inoperative by immersing it in water or otherwise exposing it to the elements, and in some cases it may be desirable to make the housing for the transmitter module 10 appear to look like the face of a clock or some other well known device so that the person wearing it may actually think that he is wearing a wristwatch. It is also important that the wristband 12 to which the transmitter module 10 is attached be a band that can be more or less permanently attached to the wrist of the resident so that the resident cannot easily remove the device even when taking a shower or a bath or at night. This means that the resident will have the transmitter module 10 on his person at all times and hence his movements through unauthorized doors will be constantly monitored.

The details of the construction and operation of the transmitter and receiver modules 10 and 14 will be described in connection with drawings. The system will also be described in connection with its use on a door opening having a single door member and on a door opening that has two adjacent door members. The differences between use on a single door opening and a double door opening will be described in detail and are necessary because institutions have both types of door openings, and it is necessary that the transmitter module 10 be required to be moved close enough to a receiving means or antenna so that a signal will be picked up in the case of a double door opening regardless of which door member is opened by the resident. It should be noted that with the present system a resident equipped with a transmitter module can move as close as he or she wants to an unauthorized door so long as the door is not opened without the receiver module being enabled to receive the transmitted signal. In other words there must be some movement of a door member to operate switch means in the circuit of the receiver before the receiver will be able to receive a signal and produce a response for sending to the nurse's station. If some door movement were not required then every time a resident equipped with a transmitter module 10 came close to a door a signal would be received and a response sent and this would be undesirable.

FIG. 1 shows the transmitter module 10 on the wristband 12 extending around a wrist. FIG. 2 shows schematically a circuit 16 for the transmitter module 10. The circuit 16 is packaged in a plastic or like container 18 which container is preferably relatively small approximating the size of a wristwatch. The container 18 is preferably sealed to be air and water tight and may be decorated to look like a wristwatch. The circuit 16 for the module 10 is constructed to transmit a radio frequency signal preferably at or about 510 kilohertz which signal is audio modulated at a frequency in the range from about 770–990 hertz. Such a signal is outside the low end of the broadcast band. The circuit 16 (FIG. 2) includes an input resistor 20 connected to a DC source and to ground through capacitor 22. A wire loop 24, shown in dotted outline, is connected across the capacitor 22 with the exposed end of the loop 24 extending from the plastic case 18. When the device is constructed and encased, the wire loop 24 forms a short circuit across the capacitor 22 to greatly reduce the flow of current from the battery and hence the loop 24 prevents the normal drain of current from the battery. This condition exists until the device is to be activated. When the device is to be installed on a resident the staff person doing the installing activates the battery by cutting off the exposed portion of the loop 24 which is the portion that extends from the case. This can be done using side cutters or a pair of scissors. When this is done the circuit is energized and transmits the signal.

The transmitter circuit 16 includes another input resistor 26 connected on one side to the connection between the resistor 20 and the capacitor 22 and has its opposite side connected to base element 28 of transistor 30. The emitter 32 of the transistor 30 is grounded, and the collector 34 is connected to one side of a capacitor 36. The transistor base 28 is also connected to one side of another capacitor 38, and the capacitors 36 and 38 have their opposite sides connected together as shown. This common connection is connected to one side of an inductor 40, the opposite side of which is connected to a 1.5 volt battery connection 42. The inductor 40 is also connected to one side of a variable tuning capacitor 44 which has its opposite side connected to the collector electrode 34 of the transistor 30. This connection is also made to one side of a second inductor 46 which has its opposite side connected to the 1.5 volt battery connection 42. The inductors 40 and 46 are preferably oriented in the module 10 to be physically located at or near right angles to each other in order to make the RF radiation pattern of the transmitted signal more uniform and omnidirectional and to reduce null conditions. At the time the transmitter module 10 is constructed the variable capacitor 44 is set to establish the frequency for the transmitted signal. This is preset and adjusted before the transmitter circuit 16 is sealed into the housing or case 18.

The transmitter module 10 also contains a battery 48, which is preferably a relatively small, low power battery capable of supplying sufficient energy to energize the transmitter module 10 to transmit a continuous signal for an extended period of time such as for a minimum of at least three months or longer. This means that after a resident has worn the transmitter module 10 for about three months the module 10 should be replaced by a new module to ensure continuing satisfactory service. When this is done the old module can be disposed of or, if desired, can be sent back to the manufacturer for a new battery. Because of the simplicity and small expense to construct the transmitter module 10 it is expected that repair of the modules even by replacing batteries may not be practical or cost effective, and it is anticipated that a new module will be put into operation and installed when the anticipated minimal usable life of the battery has been used up. This will also provide the residents with clean units from time to time.

FIG. 3 is a block diagram of the circuit for the receiver or sensing module 14 for the subject system. The sensing module 14 has a circuit 50 which includes an AM radio receiver portion 52 connected to an antenna 54 mounted on or adjacent to a door or doors of an opening to an institution or the like. The details of the antenna means will be described later. The AM receiver 52 is tuned to the transmitting frequency of the transmitter module 10, i.e., 510 kilohertz. The output of the receiver 52 is fed on lead 53 to a signal limiter circuit 56 which produces therefrom a constant amplitude output which is fed on lead 55 to and through a tone decoder circuit 58. The output of the tone decoder circuit 58 is fed on lead 61 to a circuit identified as the initial power turn-on delay circuit 62. The output of the circuit 62 is fed on lead 63 to the input to a low frequency filter circuit 64 the output of which is connected by lead 65 to an output circuit stage 66. The output circuit stage 66 is in turn connected to supply an output signal on lead 67 to energize an alarm device 68 to alert a nurse or other staff person at a suitable location such as the nursing station that a resident is trying to pass through an unauthorized door. The alarm circuit 68 also has a reset connection on lead 70 that is connected back to the output stage 66. This connection enables the circuit to be reset after an alarm is detected so that the device is again able to produce an alarm. The alarm 68 may also be connected to an RF digital transmitter 72 for sending the signal to other stations or to a center where a record is kept of each alarm event. The audio modulation of the radio frequency signal can also be used to identify each person having a transmitter so that not only will the alarm be indicated but the system will also be able to identify particular residents. This feature is optional and may not be required by all institutions.

The circuit described above in block form has certain features which recommend it for the present purpose including having high immunity to random noise, tight control of the tone decoder frequency, and wireless provision for remote alarm reporting at distant nursing stations. The circuit also enables operation at or below the low end of the broadcast radio spectrum resulting in reasonable costs for capital equipment which is an important factor that makes the present system cost effective for nursing homes and other institutions. The present system therefore provides security for wandering residents at minimal personnel and other costs, and because of the provision of the two ferrite inductors 40 and 46 at right angles in the transmitter modules 10, the system is relatively difficult to defeat should a resident trying to exit orient his transmitting module in such a way as to try to avoid signal reception. The receiving or sensing module 14 is also preferably constructed of relatively few parts and can be made as a compact unit for installing on a doorjamb or adjacent to a doorjamb or even on a door in some circumstances. It is also possible because of its relatively small size to construct the sensing module 14 to blend into the decor of the building so that it is not easily seen, and it is contemplated to recess it into a wall for even better hiding. The better the sensing modules are hidden, the less likely that somebody will try to defeat the system by damaging the receiver. However, since the receiver module is a more or less permanent part of the system it is preferred that it be installed in such a manner that it can be removed for repair and maintenance if necessary.

FIG. 4 is a more detailed diagram of the circuit for the receiver module 14. In the circuit diagram of FIG. 4 ferrite inductors 74 and 76 including ferrite cores 78 and 80 and respective coils 82 and 84 are mounted as shown. The coil 82 on the inductor 74 is connected to a jack 86 for an external sensor and the coil 84 of the inductor 76 is shown connected directly to the superheterodyne AM radio receiver 52. Other types of receivers including tuned radio frequency as well as FM receivers could also be used. The output of the receiver 52 is applied to primary coil 88 of transformer 90 which has its secondary winding 92 grounded on one side and connected on the opposite side to the input of a circuit which includes a pair of oppositely polarized diodes 94 and 96 which are grounded as shown. The non-grounded side of the transformer secondary 92 is also connected to one side of an optional circuit 98 for preventing damage due to transient conditions and which includes capacitor 100 connected in series with inductor or choke 102. The transformer secondary 92 is also connected through another capacitor 104 to the input of a two stage audio filter circuit 106 which is constructed and adjusted to have an operating range between about 770 hz and 990 hz. The output of the filter circuit 106 is connected through resistor 108 to base element 110 of transistor 112. The transistor 112 is connected to a base to emitter biasing circuit formed by parallel connected resistor 114 and capacitor 116 which are connected to a DC potential terminal 118 which may be from a battery or from the output of a rectifier circuit.

The collector 120 of the transistor 112 is connected through another resistor 122 to one side of relay circuit shown as including a relay coil 124 connected in parallel with diode 126, the opposite sides of which are grounded. The relay coil 124 operates a relay contact 128 which is connected into a circuit between DC potential at terminal 130 and an output circuit which includes an audio beeper 132 and the transmitter circuit 72. The diode 126 is included to prevent back EMFs or voltages from damaging the transistor 112. The high voltage side of the relay coil 124 is also connected through reset pushbutton switch 134, resistor 136 and grounded diode 138. This circuit has a connection through the normally open side of the relay switch 128 to DC voltage terminal 130 when the relay is energized. When the pushbutton switch 134 is actuated it disconnects power from the relay coil 124 deenergizing it and opening the relay contact 128.

One side of beeper 132 is connected to another DC voltage terminal 140 and the opposite side is connected to collector electrode 141 of transistor 142. The emitter 143 of the transistor 142 is grounded and the base 144 of the transistor 142 is connected through resistor 145 to one side of the relay contact 128. Application of positive voltage to the base of the transistor 142 will turn on the transistor 142 to conduct and in so doing will energize the beeper 132. The beeper 132 will therefore be energized whenever a resident equipped with a transmitter is trying to pass through an unauthorized doorway and in so doing causes a signal to be received by the receiver 14 to energize the relay 124. The radio transmitter 72 will also be activated at the same time as the beeper 132 to transmit a signal to other nurse's stations if there are such in the institution. This is done to make the alarm more general and, if necessary, to keep track of alarms. The transmitter 72 is connected to the DC source connection 130 through another resistor 146 connected as shown.

The circuit of FIG. 4 also includes a power supply portion 147 which is shown as including a plug-in receptacle 148. The power supply is shown as being a regulated twelve volt power supply 150 having a twelve volt DC output at terminal 152 and an eighteen volt DC output at terminal 154.

Figure 5:
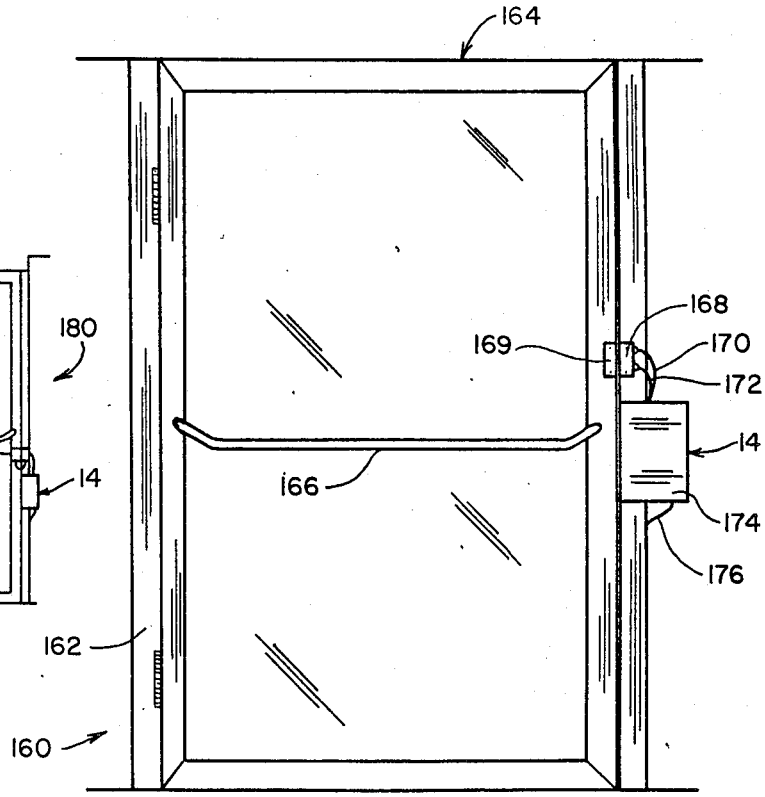
FIG. 5 is an elevational view showing an exit at an institution such as a nursing home equipped with a receiver module such as shown in FIGS. 3 and 4.

FIG. 5 shows a door assembly 160 having a doorjamb 162 and a single door member 164 hingedly mounted therein. Such doors are common as exit doors for institutions such as nursing homes and the like. The door 164 has an operating handle 166 which is pushed to unlatch the door so it can be opened and a switch 168 is mounted on the doorjamb 162 adjacent to the non-hinged side of the door 164 which cooperates with an actuator member 169 located on the door 164 as shown. When the door is closed the switch 168 is closed and when the door is open the switch 168 opens. The switch 168 may be a mechanical switch, an electronic switch or a magnetic switch. The switch 168 is connected by leads 170 and 172 to a housing 174 in which the receiver circuit 14 is located. The housing 174 has an output cable 176 which connects it to a remote nursing station where the alarm or buzzer is located and it also has a connection to a source of power. When the door 164 is closed the receiver circuit 16 is incapable of receiving signals from the transmitters 10 but when the door 164 is open it can receive such signals. The switch 168 is a normally closed switch and is connected into the circuitry of the receiver 14 between the base 110 and the emitter of the transistor 112. When the door is closed, the switch 168 (see also FIG. 4) is not actuated (closed) and will short between the base and the emitter of the transistor 112. This prevents the transistor 112 from energizing the relay 124.

Figure 7:
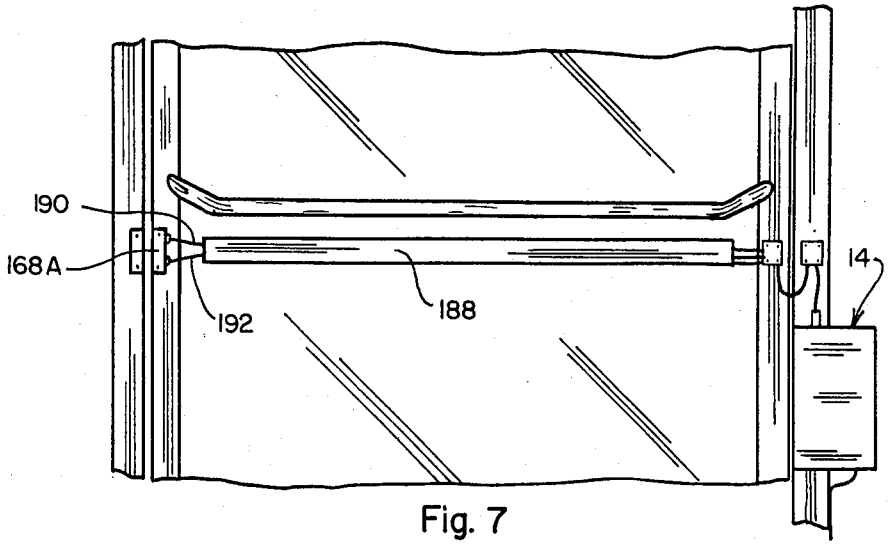
Figure 6:
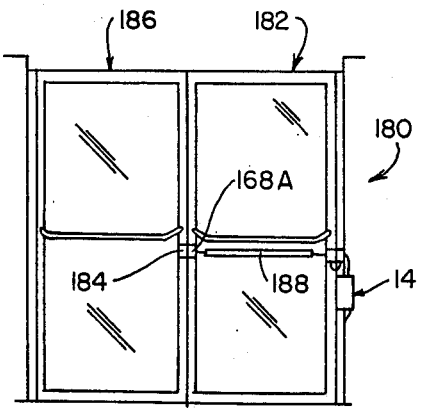
FIG. 6 is an elevational view similar to FIG. 5 but showing the receiver module mounted for use at a double door opening; and, FIG. 7 is an enlarged fragmentary elevational view of the central portion of the right hand door shown in FIG. 6.

FIGS. 6 and 7 show the receiver 14 mounted for use on a double door opening 180. In this case switch 168A is mounted on the outboard side of door member 182 and is adjacent to actuator 184 located on the other or second door member 186. In the double door construction 180 the door member 182 also has a sensor strip 188 extending thereacross. The sensor strip 188 contains leads 190 and 192 that connect to the switch 168A, and the strip 188 also serves as an antenna so that the resident will not be able to defeat the system by trying to create too great a distance between the transmitter 10 on his or her wrist and the sensor or pick-up connected to the receiver 14. The strip 188 can be adhesively or otherwise attached to the door 182. It is also contemplated to mount a similar receiver unit on each opposite side of the double door opening and connect them together by a wire that extends around or over the door opening. In such case one of the receivers may be considered as the master receiver and the other as the slave. This construction will eliminate the need for attaching a sensor strip such as the strip 188 to one of the door members.

Thus there has been shown and described a personnel security system which fulfills all of the objects and advantages sought therefor. It will be apparent to those skilled in the art, however, that many changes, modifications, variations, and other uses and applications for the present system are possible. All such changes, modifications, variations, and other uses and applications which do not depart from the spirit and scope of the invention are deemed to be covered by the invention which is limited only by the claims which follow.

What is claimed is:

1. A security sensing system for monitoring the passage of persons through a door or like opening comprising:

a transmitter module for installing on persons to be monitored, a sensing module for installing adjacent to a door opening to be monitored, and means responsive to the opening of the door to enable the sensing module to respond to the signal transmitted by the transmitter module to produce an output response, and alarm means energizable in response to the production of the output response to produce an alarm condition, the transmitter module including a housing having a transmitter circuit, a source of power for the transmitter circuit and transmitter antenna means installed therein, the sensing module including a receiving circuit and associated sensing means located adjacent to the door opening to be monitored, and said means responsive to the opening of the door including means to enable the receiving circuit in the sensing module whereby the receiving circuit can respond to signals transmitted by the transmitter module to produce a response for energizing the alarm means.

2. The security sensing system of claim 1 wherein the transmitter antenna means includes a pair of inductors mounted in the housing at substantially right angles.

3. The security sensing system of claim 1 wherein the housing for the transmitter module is a sealed housing.

4. The security sensing system of claim 1 wherein the door opening accommodates two door members and the sensing module is located adjacent to the door opening and includes an elongated sensing member mounted extending transversely across at least one of the door members in the door opening.

5. The security sensing system of claim 1 wherein the sensing module includes a radio frequency receiver having an input connected to the sensing means, an output including signal limiting and filtering means and relay means energizeable when a signal is received from the transmitter module to energize the alarm means.

6. Means to monitor a doorway of a nursing home or other institution in order to produce an alarm when certain residnets try to pass therethrough comprising a transmitter device including a mounting band therefor to be worn on the wrist of the residents to be monitored, said transmitter device having a housing with a modulating circuit, a transmitter radiator and a battery source located therein, a receiving device for mounting adjacent to the doorway including a housing and a receiving circuit therein, a signal sensor operatively connected to the receiving circuit, means for supplying power to the receiving circuit, means to enable the receiving circuit, and an output for the receiving circuit, an alarm producing device operatively connected to the output of the receiving circuit, and said means to enable including switch means operatively connected to the receiving circuit, said switch means being mounted in association with the doorway and having a first condition when the doorway is open and a second condition when the doorway is closed, the first condition of the switch means operating to enable the receiving circuit.

7. The means to monitor of claim 6 wherein the transmitter device includes a weathertight housing having a severable loop of wire extending therefrom, the loop having an operative connection to the modulating circuit therein such that when unsevered the loop prevents energizing of the transmitter device, severing of the loop operating to energize the transmitter device.

8. The means to monitor of claim 6 wherein the radiator in the transmitter device includes a pair of angularly related inductor elements.

9. The means to monitor of claim 6 wherein the modulating circuit is tuned to transmit a signal from the radiator at a radio frequency that is outside of the broadcast band.

10. The means to monitor of claim 6 wherein the transmitter device produces a radio frequency output audio modulated at a frequency between about 770 to 990 hertz.

11. The means to monitor of claim 6 wherein the receiving circuit includes a radio frequency receiver circuit portion.

12. The means to monitor of claim 6 wherein the signal sensor includes a pair of angularly oriented inductor elements.

13. The means to monitor of claim 6 wherein the receiving circuit includes signal limiting and signal filtering means, and an output circuit stage, and means including relay means operatively connected to the output circuit stage, said alarm producing means being energizable under control of the relay means.

14. The means to monitor of claim 13 including a radio transmitter operatively connected to the relay means and energizable with the alarm producing means to transmit a signal to remote locations.

15. The means to monitor of claim 6 wherein the doorway being monitored has two adjacent door members, the receiving device being mounted adjacent one of the door members and the switch means being mounted having a switch portion mounted on one of the door members and a switch actuator portion mounted on the other of said door members, said switch portion and said switch actuator portion being adjacent one another when the two adjacent door members are closed.

16. The means to monitor of claim 6 wherein the modulating circuit includes transistor elements.

17. The means to monitor of claim 6 wherein the receiving circuit includes transistor elements.

18. The means to monitor of claim 6 wherein the doorway being monitored is a relatively wide doorway and a separate receiving device is mounted adjacent each opposite side thereof, and means connecting the separate receiving devices on opposite sides of the doorway whereby one of the receiving devices operates as a master and the other as a slave receiving device.

* * * * *

UNITED STATES PATENT OFFICE

CERTIFICATE OF CORRECTION

Patent No. 4,682,155 Dated July 21, 1987

Inventor(s) John R. Shirley

It is certified that error appears in the above-identified patent and that said Letters Patent are hereby corrected as shown below:

Column 9, line 33, "residnets" should be --residents--.

Signed and Sealed this

Third Day of November, 1987

*Attest:*

*Attesting Officer*

DONALD J. QUIGG

*Commissioner of Patents and Trademarks*